US006653584B1

(12) United States Patent
Chen

(10) Patent No.: US 6,653,584 B1
(45) Date of Patent: Nov. 25, 2003

(54) SUCCESSIVE SWITCH DEVICE OF A SLOT CUTTING MACHINE

(75) Inventor: Ruey Zon Chen, Dali (TW)

(73) Assignee: Rexon Co., Ltd., Taichung Hsien (TW)

( * ) Notice: Subject to any disclaimer, the term of this patent is extended or adjusted under 35 U.S.C. 154(b) by 0 days.

(21) Appl. No.: 10/153,782

(22) Filed: May 24, 2002

(51) Int. Cl.[7] ..... H01H 9/06

(52) U.S. Cl. ..... 200/332.2; 200/322; 200/321; 200/43.17

(58) Field of Search ..... 200/332.2, 318, 200/318.1, 318.2, 321, 322, 322.1, 293.1, 522, 43.16, 43.17, 43.18, 43.19

(56) References Cited

U.S. PATENT DOCUMENTS 3,579,022 A * 5/1971 Hennig et al. ..... 378/125
3,869,591 A * 3/1975 Piber ..... 200/321
6,057,518 A * 5/2000 Bascom et al. ..... 200/43.17
6,218,633 B1 * 4/2001 Okumura et al. ..... 200/43.17
6,288,350 B1 * 9/2001 Campbell et al. ..... 200/321

* cited by examiner

*Primary Examiner*—Elvin Enad
*Assistant Examiner*—Lisa Klaus
(74) *Attorney, Agent, or Firm*—Rosenberg, Klein & Lee

(57) ABSTRACT

A successive switch device of a slot cutting machine includes opposite first push button and second push button mounted on the handle, and a positioning block secured on secured on the press switch. The first push button and the second push button may be locked with the positioning block, so that the press switch may be positioned after being pressed. Thus, the slot cutting machine may be operated successively. In addition, the slot cutting machine is available for the right-handed and left-handed users.

7 Claims, 6 Drawing Sheets

SUCCESSIVE SWITCH DEVICE OF A SLOT CUTTING MACHINE

BACKGROUND OF THE INVENTION

1. Field of the Invention

The present invention relates to a successive switch device of a slot cutting machine, and more particularly to a successive switch device of a slot cutting machine, wherein the press switch may be positioned after being pressed, so that the slot cutting machine may be operated successively.

2. Description of the Related Art

A conventional slot cutting machine in accordance with the prior art is a tool machine that may be used to cut a semi-circular slot or breach in a workpiece. Usually, the conventional slot cutting machine is operated in a hand-held manner, so that the user's hand may directly press the start switch to operate the conventional slot cutting machine. However, the user's hand has to press the start switch successively, so that the conventional slot cutting machine may be operated normally, thereby causing inconvenience to the user. In addition, if the pressing force exerted by the user's hand on the start switch is removed or paused, the conventional slot cutting machine will stop operating, so that the conventional slot cutting machine is operated intermittently and cannot be operated successively, thereby affecting the processing precision of the surface of the workpiece.

SUMMARY OF THE INVENTION

The present invention has arisen to mitigate and/or obviate the disadvantage of the conventional slot cutting machine.

The primary objective of the present invention is to provide a successive switch device of a slot cutting machine, wherein the press switch may be positioned after being pressed, so that the slot cutting machine may be operated successively.

Another objective of the present invention is to provide a successive switch device of a slot cutting machine, A further objective of the present invention is to provide a successive switch device of a slot cutting machine, wherein the slot cutting machine is available for the right-handed and left-handed users.

In accordance with the present invention, there is provided a successive switch device of a slot cutting machine, comprising:

- a positioning block, secured on secured on a press switch, and formed with a through hole, the through hole of the positioning block having an inner wall formed with a positioning flange;
- a first push button, mounted at one side of the positioning block, and having one side formed with a protruding catch portion, the catch portion of the first push button aligning with the through hole of the positioning block and capable of being locked in the positioning flange of the through hole of the positioning block;
- a second push button, mounted at the other side of the positioning block, and located opposite to the first push button, the second push button having one side formed with a protruding catch portion, the catch portion of the second push button aligning with the through hole of the positioning block and capable of being locked in the positioning flange of the through hole of the positioning block; and
- an elastic member, mounted between the first push button and the second push button.

Preferably, the first push button and the second push button are mounted on a handle of the slot cutting machine.

Preferably, the positioning flange is located at a top corner of the inner wall of the through hole of the positioning block.

Preferably, the elastic member has a first end rested on the catch portion of the first push button and a second end rested on the catch portion of the second push button.

Preferably, the catch portion of the first push button is formed with a hole for receiving the first end of the elastic member.

Preferably, the catch portion of the second push button is formed with a shaft which is formed with a hole for receiving the second end of the elastic member.

Preferably, the positioning block is moved with the press switch, so that a selective one of the catch portion of the first push button and the catch portion of the second push button may be locked in the positioning flange of the through hole of the positioning block.

Further benefits and advantages of the present invention will become apparent after a careful reading of the detailed description with appropriate reference to the accompanying drawings.

DETAILED DESCRIPTION OF THE INVENTION

Figure 1:
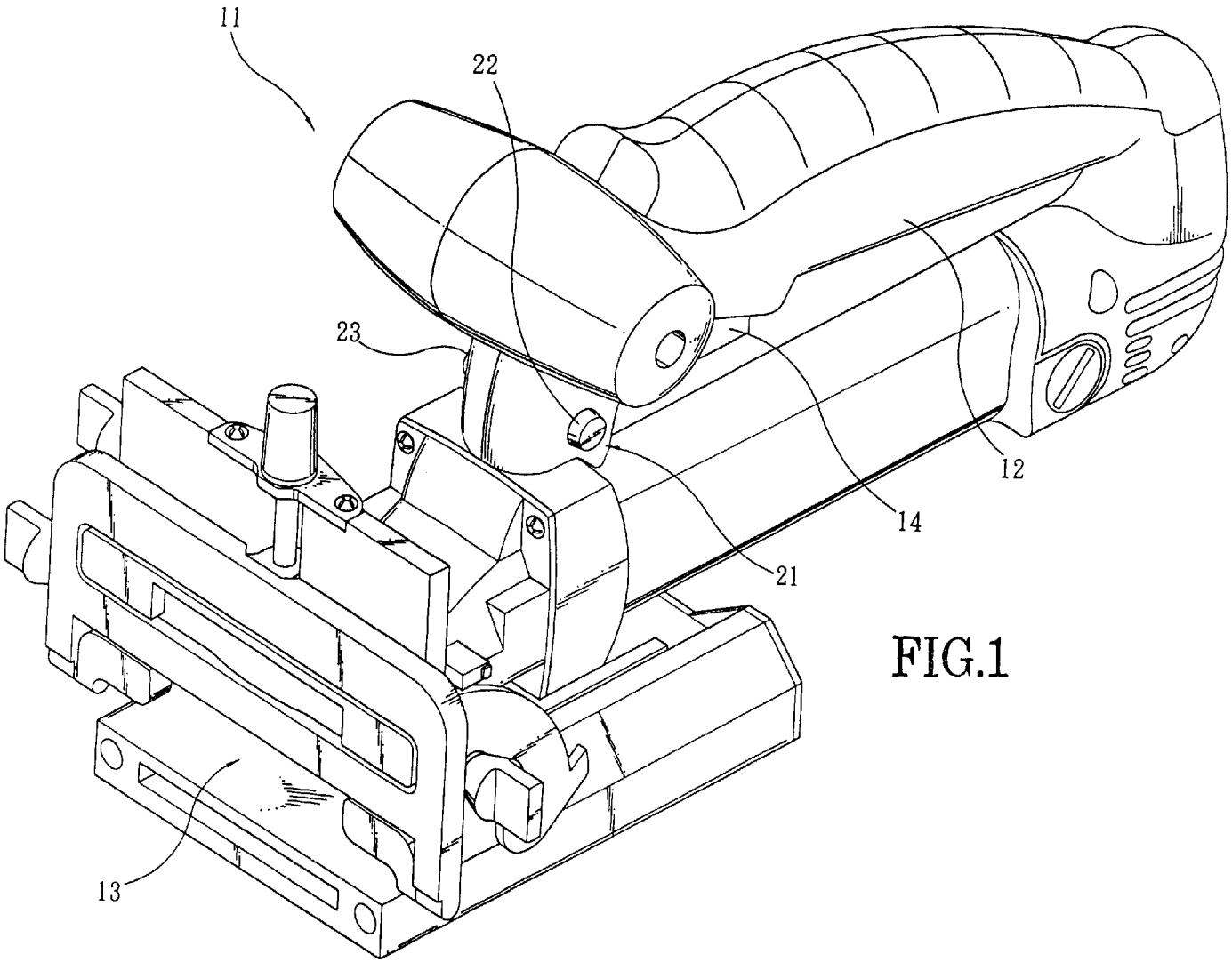
FIG. 1 is a perspective view of a slot cutting machine in accordance with a preferred embodiment of the present invention.
Figure 2:
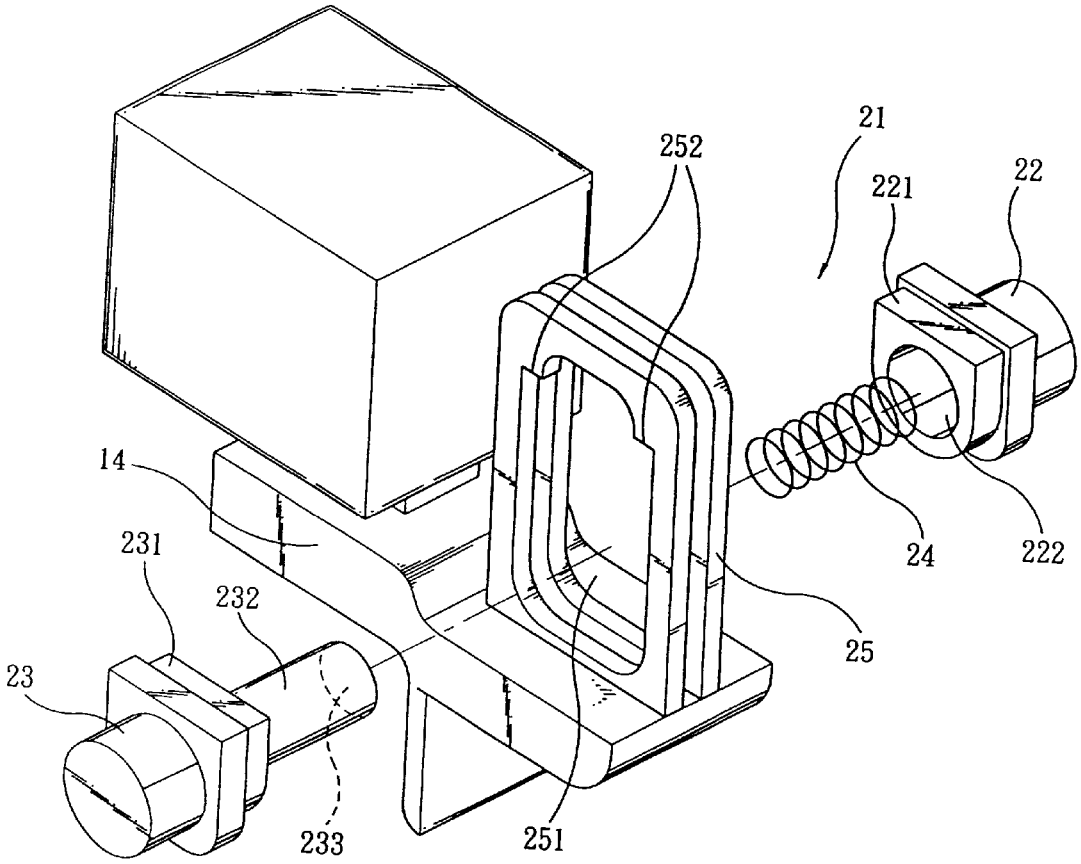
FIG. 2 is an exploded perspective assembly view of a successive switch device of the slot cutting machine in accordance with a preferred embodiment of the present invention.

Referring to the drawings and initially to FIGS. 1 and 2, a successive switch device 21 of a slot cutting machine 11 in accordance with a preferred embodiment of the present invention is shown.

The slot cutting machine 11 comprises a handle 12, and a set of retaining mechanism 13 that may be rested on the workpiece. The handle 12 is provided with a press switch 14 that may be used to start the slot cutting machine 11 to operate normally.

The successive switch device 21 is mounted on the handle 12 for fixing and positioning the press switch 14 temporarily, so that the press switch 14 may be temporarily maintained at a fixed position after being pressed.

The successive switch device 21 includes a first push button 22, a second push button 23, an elastic member 24, and a positioning block 25.

The first push button 22 has one side formed with a protruding catch portion 221. The catch portion 221 of the first push button 22 is formed with a hole 222. As shown in FIG. 1, the first push button 22 is mounted on one side of the handle 12.

The second push button 23 has one side formed with a protruding catch portion 231. The catch portion 231 of the second push button 23 is formed with a protruding shaft 232. The shaft 232 of the catch portion 231 of the second push button 23 is axially formed with a hole 233. As shown in FIG. 1, the second push button 23 is mounted on the other side of the handle 12, and is located opposite to the first push button 22.

The elastic member 24 is mounted in the handle 12, and is biased between the first push button 22 and the second push button 23. The elastic member 24 has a first end received in the first push button 22 and a second end received in the second push button 23, thereby positioning the elastic member 24.

The positioning block 25 is secured on the press switch 14, and may be moved with the press switch 14. The positioning block 25 has a center formed with a through hole 251. The through hole 251 of the positioning block 25 has an inner wall having a top corner formed with a positioning flange 252 extended inward.

It is appreciated that, after the first push button 22, the second push button 23 and the positioning block 25 are assembled, the catch portion 221 of the first push button 22 and the catch portion 231 of the second push button 23 are matingly located at the two sides of the through hole 251 of the positioning block 25.

Figure 3:
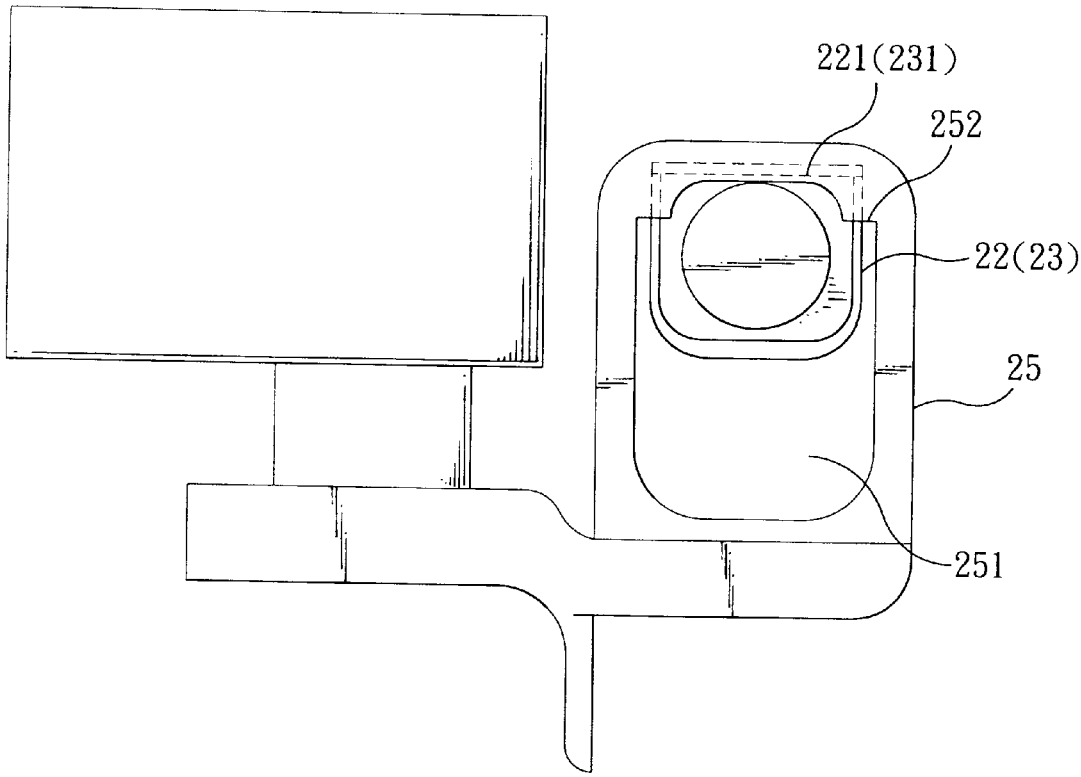
FIG. 3 is a plan assembly view of the successive switch device of a slot cutting machine as shown in FIG. 2.

Referring to FIG. 3, after the first push button 22 and the second push button 23 are assembled, the top edge of each of the catch portion 221 of the first push button 22 and the catch portion 231 of the second push button 23 is higher than the positioning flange 252 of the through hole 251 of the positioning block 25.

Figure 4:
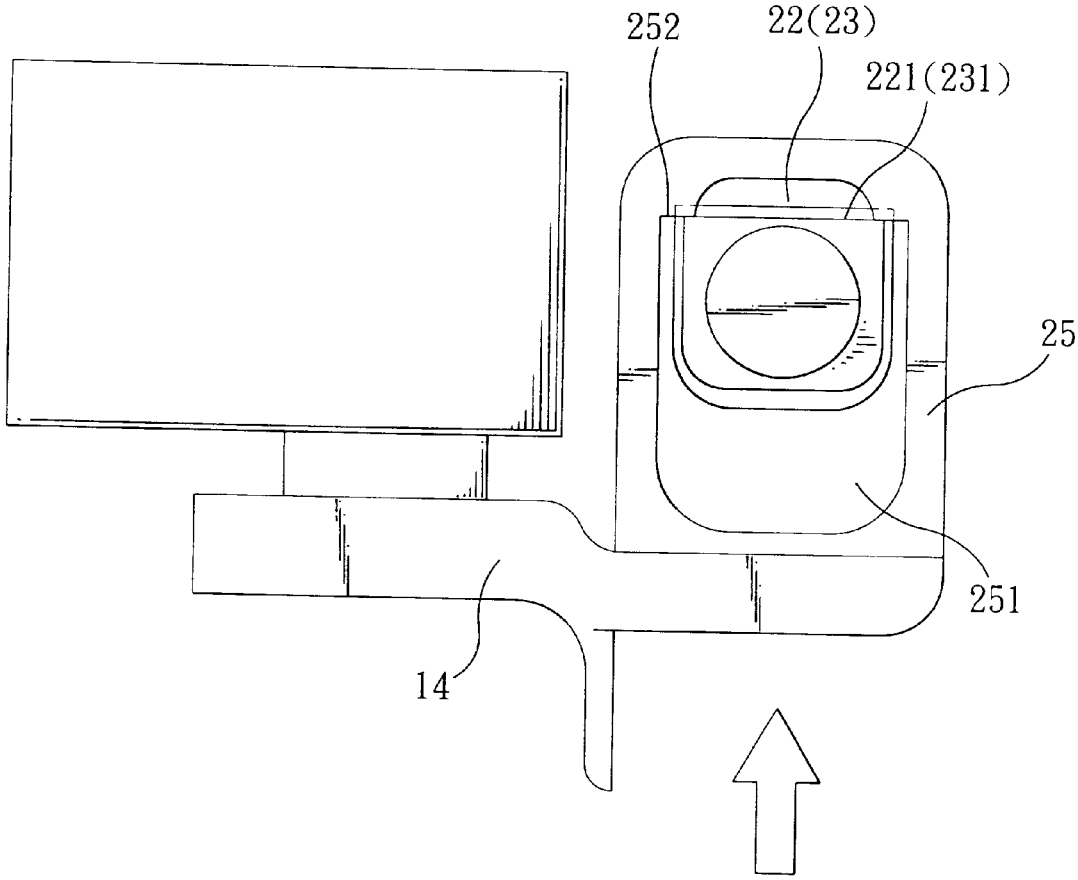
FIG. 4 is a schematic operational view of the successive switch device of a slot cutting machine as shown in FIG. 3 in use.

Referring to FIG. 4, when in use, the press switch 14 may be pressed upward as shown in the figure. Thus, the positioning block 25 secured on the press switch 14 may be moved upward with the press switch 14, so that the positioning flange 252 of the through hole 251 of the positioning block 25 is higher than the top edge of each of the catch portion 221 of the first push button 22 and the catch portion 231 of the second push button 23.

Figure 5:
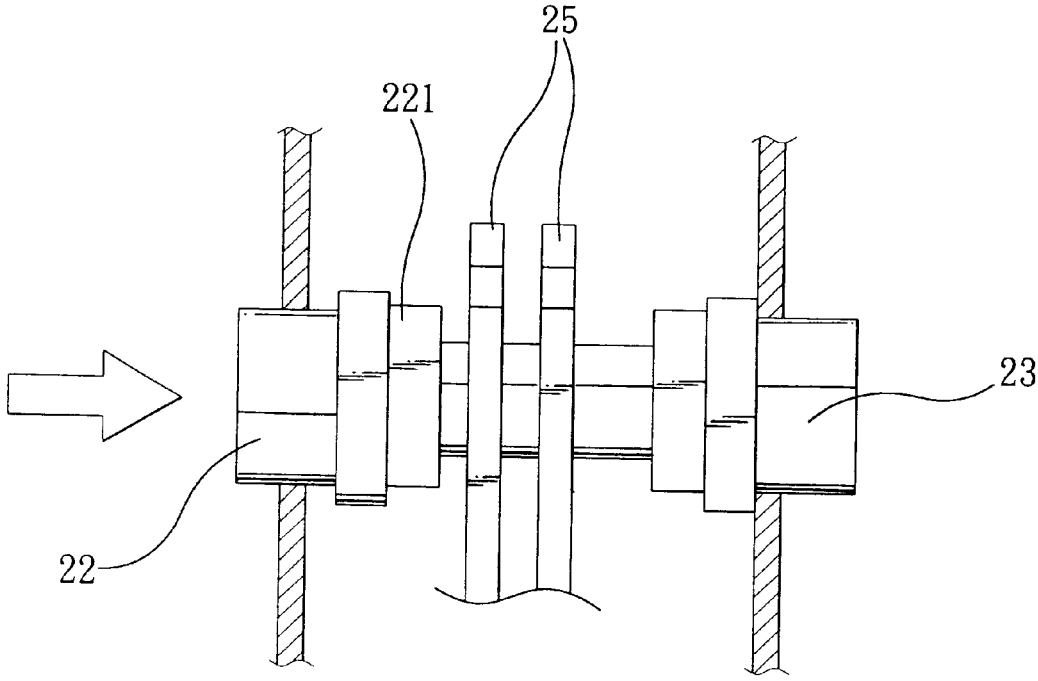
FIG. 5 is a plan assembly view of the successive switch device of a slot cutting machine as shown in FIG. 2.

Referring to FIG. 5, the user may then press the first push button 22, so that the catch portion 221 of the first push button 22 may approach the positioning block 25. Similarly, the user may then press the second push button 23, so that the catch portion 231 of the second push button 23 may approach the positioning block 25.

Figure 6:
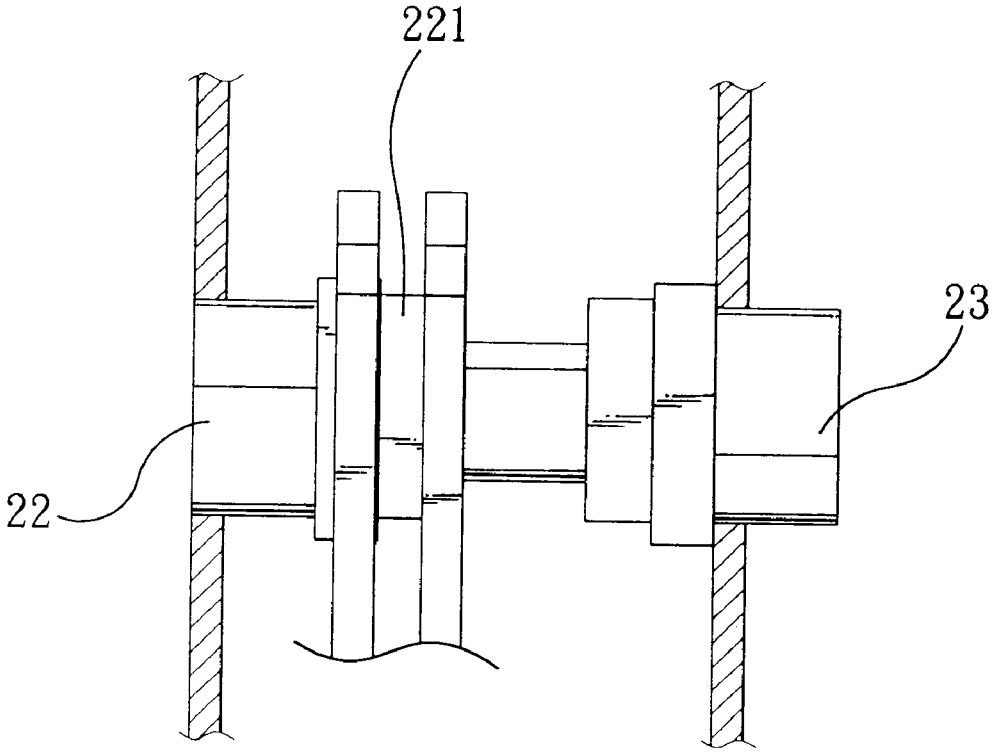
FIG. 6 is a schematic operational view of the successive switch device of a slot cutting machine as shown in FIG. 5 in use.

Referring to FIGS. 4 and 6, when the catch portion 221 of the first push button 22 enters the through hole 251 of the positioning block 25, the pressing force exerted by the user on the press switch 14 may be removed. At this time, the press switch 14 may be displaced downward automatically, so that the catch portion 221 of the first push button 22 may be locked in the positioning flange 252 of the through hole 251 of the positioning block 25, thereby positioning the positioning block 25, and thereby positioning the press switch 14 by the first push button 22.

Similarly, when the catch portion 231 of the second push button 23 enters the through hole 251 of the positioning block 25, the pressing force exerted by the user on the press switch 14 may be removed. At this time, the press switch 14 may be displaced downward automatically, so that the catch portion 231 of the second push button 23 may be locked in the positioning flange 252 of the through hole 251 of the positioning block 25, thereby positioning the positioning block 25, and thereby positioning the press switch 14 by the second push button 23.

Thus, the second push button 23 or the first push button 22 may co-operate with the positioning block 25, so as to fix and position the press switch 14 temporarily, so that the slot cutting machine 11 may be operated successively, without having to press the press switch 14 continuously.

As shown in FIG. 1, the second push button 23 is mounted on the other side of the handle 12, and is located opposite to the first push button 22, so that the right-handed user may press the first push button 22, and the left-handed user may press the second push button 23. Thus, the user, no matter the right-handed user or the left-handed user, may press the first push button 22 or the second push button 23 easily and conveniently, so as to fix and position the press switch 14 temporarily, so that the successive switch device 21 in accordance with the present invention may satisfy the practical requirement of any user, thereby facilitating the user operating the slot cutting machine 11, and thereby enhancing the versatility of the slot cutting machine 11.

When the user again presses the press switch 14, the catch portion 221 of the first push button 22 or the catch portion 231 of the second push button 23 may be detached from the positioning flange 252 of the through hole 251 of the positioning block 25, so that the first push button 22 or the second push button 23 may be pushed to return to the original position. At this time, the press switch 14 may be displaced downward automatically, to return to the original position, so as to stop operation of the slot cutting machine 11.

Although the invention has been explained in relation to its preferred embodiment as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A successive switch device of a slot cutting machine, comprising:

a positioning block, secured on a press switch, and formed with a through hole, the through hole of the positioning block having an inner wall formed with a positioning flange;

a first push button, mounted at one side of the positioning block, and having one side formed with a protruding catch portion, the catch portion of the first push button aligning with the through hole of the positioning block and capable of being locked in the positioning flange of the through hole of the positioning block;

a second push button, mounted at the other side of the positioning block, and located opposite to the first push button, the second push button having one side formed with a protruding catch portion, the catch portion of the second push button aligning with the through hole of the positioning block and capable of being locked in the positioning flange of the through hole of the positioning block; and an elastic member, mounted between the first push button and the second push button.

2. The successive switch device of a slot cutting machine in accordance with claim 1, wherein the first push button and the second push button are mounted on a handle of the slot cutting machine.

3. The successive switch device of a slot cutting machine in accordance with claim 1, wherein the positioning flange is located at a top corner of the inner wall of the through hole of the positioning block.

4. The successive switch device of a slot cutting machine in accordance with claim 1, wherein the elastic member has a first end rested on the catch portion of the first push button and a second end rested on the catch portion of the second push button.

5. The successive switch device of a slot cutting machine in accordance with claim 4, wherein the catch portion of the first push button is formed with a hole for receiving the first end of the elastic member.

6. The successive switch device of a slot cutting machine in accordance with claim 4, wherein the catch portion of the second push button is formed with a shaft which is formed with a hole for receiving the second end of the elastic member.

7. The successive switch device of a slot cutting machine in accordance with claim 1, wherein the positioning block is moved with the press switch, so that a selective one of the catch portion of the first push button and the catch portion of the second push button may be locked in the positioning flange of the through hole of the positioning block.

* * * * *